United States Patent [19]

Leising

[11] Patent Number: 4,637,479

[45] Date of Patent: Jan. 20, 1987

[54] METHODS AND APPARATUS FOR CONTROLLED DIRECTIONAL DRILLING OF BOREHOLES

[75] Inventor: Lawrence J. Leising, Rosenberg, Tex.

[73] Assignee: Schlumberger Technology Corporation, New York, N.Y.

[21] Appl. No.: 740,110

[22] Filed: May 31, 1985

[51] Int. Cl.[4] ..... E21B 7/08

[52] U.S. Cl. ..... 175/26; 175/38; 175/45; 175/61

[58] Field of Search ..... 175/26, 38, 45, 61, 175/67, 324, 339, 340, 393

[56] References Cited

U.S. PATENT DOCUMENTS

| | | | |
|---|---|---|---|
| 2,075,064 | 3/1937 | Schumacher et al. | 255/1 |
| 2,142,559 | 1/1939 | Duus | 175/45 |
| 2,873,092 | 2/1959 | Dwyer | 175/61 |
| 2,956,781 | 10/1960 | Eastman | 175/61 |
| 3,309,565 | 3/1967 | Clark et al. | 315/117 |
| 3,313,360 | 4/1967 | Frisby | 175/45 |
| 3,360,057 | 12/1967 | Anderson | 175/67 |
| 3,365,007 | 10/1965 | Skipper | 175/61 |
| 3,457,999 | 7/1969 | Massey | 175/61 |
| 3,488,765 | 1/1970 | Anderson | 175/61 |
| 3,593,810 | 7/1971 | Fields | 175/61 |
| 3,599,733 | 8/1971 | Varkey | 175/61 |
| 3,693,142 | 9/1972 | Jones | 175/45 |
| 3,764,970 | 10/1973 | Manning | 340/18 |
| 4,307,786 | 12/1981 | Evans | 175/231 |
| 4,416,339 | 11/1983 | Baker et al. | 175/61 |

*Primary Examiner*—Stephen J. Novosad
*Assistant Examiner*—William P. Neuder

[57] ABSTRACT

In the representative embodiments of the present invention described herein, a new and improved directional drilling tool carrying a rotable drilling bit is dependently coupled to a rotatable drill string for excavating a borehole along one or more selected courses of excavation. Passage means on the directional drilling tool are communicated with the several fluid-discharge passages in the drill bit. A rotating flow obstructing member is arranged in the directional drilling tool for selectively communicating the drilling fluid with the bit passages as the drill bit is rotated. A selectively operable driver is arranged for rotating the flow-obstructing member at one rotational speed when it is desired to sequentially discharge drilling fluid into most, if not all, adjacent sectors of the borehole as the drill bit rotates so as to advance the drill bit along a generally linear course of excavation. Alternatively, by rotating the flow-obstructing member at a different rotational speed, drilling fluid is sequentially discharged from the bit passages into only a single peripheral sector of the borehole to divert the drill bit to another course of excavation. Various controls are disclosed for utilizing typical directional measurements to control the direction of excavation.

22 Claims, 12 Drawing Figures

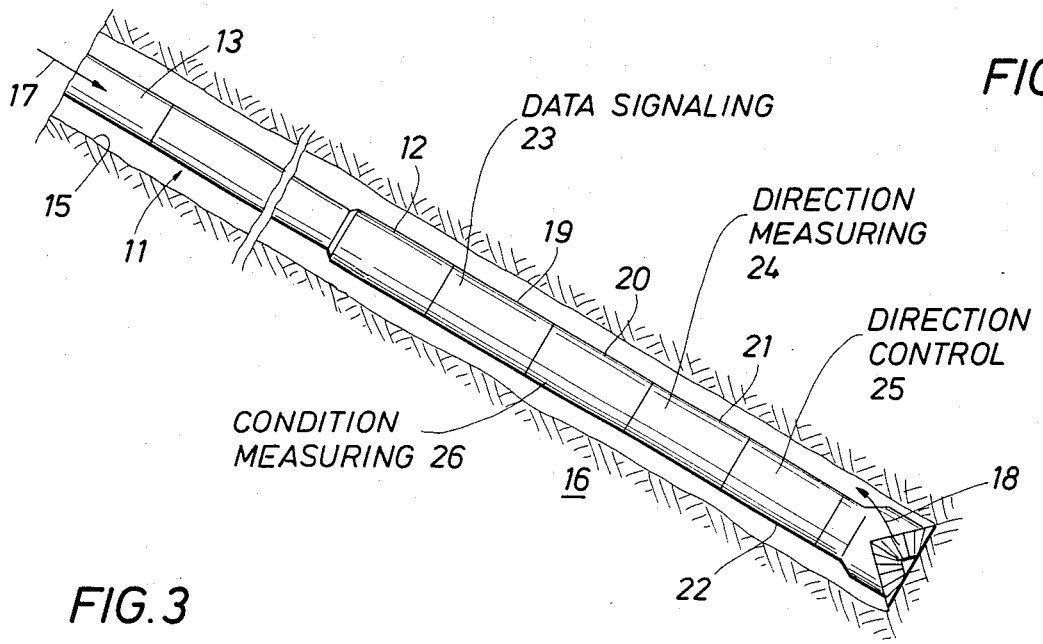
FIG. 1
13
17
DATA SIGNALING
23
12
15
11
19
DIRECTION
MEASURING
24
20
21
DIRECTION
CONTROL
25
CONDITION
MEASURING 26
16
18
22

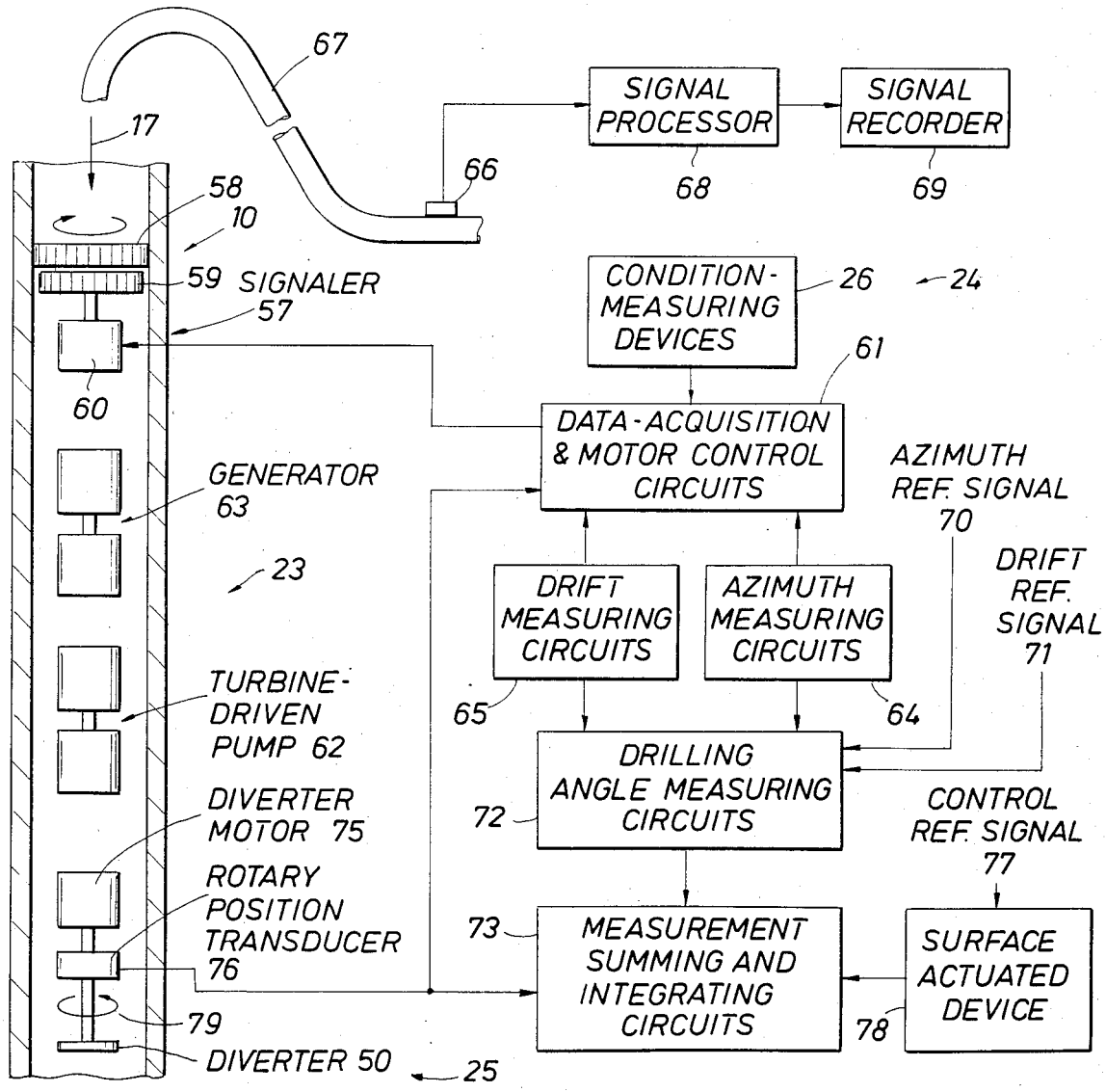
FIG. 3
67
17
SIGNAL
PROCESSOR
SIGNAL
RECORDER
66
68
69
58
10
59 SIGNALER
57
CONDITION-
MEASURING
DEVICES
26
24
61
60
DATA-ACQUISITION
& MOTOR CONTROL
CIRCUITS
AZIMUTH
REF. SIGNAL
70
GENERATOR
63
23
DRIFT
MEASURING
CIRCUITS
AZIMUTH
MEASURING
CIRCUITS
DRIFT
REF.
SIGNAL
71
TURBINE-
DRIVEN
PUMP 62
65
64
DRILLING
ANGLE MEASURING
CIRCUITS
DIVERTER
MOTOR 75
72
CONTROL
REF. SIGNAL
77
ROTARY
POSITION
TRANSDUCER
76
73
MEASUREMENT
SUMMING AND
INTEGRATING
CIRCUITS
SURFACE
ACTUATED
DEVICE
79
78
DIVERTER 50
25

METHODS AND APPARATUS FOR CONTROLLED DIRECTIONAL DRILLING OF BOREHOLES

BACKGROUND OF THE INVENTION

In present day oil well drilling operations it is becoming increasingly important to have the capability of selectively controlling the directional course of the drill bit. Such controlled directional drilling particularly important in any offshore operation where a number of wells are to be drilled from a central drilling platform or vessel so as to individually reach selected target areas respectively situated at different depths, azimuthal orientations and horizontal displacements from the drilling platform. Moreover, in any offshore or inland drilling operation, there are many situations where the drill bit must be deliberately diverted laterally to complete the drilling of the borehole.

Those skilled in the art will, of course, appreciate that many types of directional drilling tools have been proposed in the past. For instance, one of the best known tools in use today is a so-called "whipstock tool" which is cooperatively arranged for drilling a reduced diameter pilot hole in a desired lateral direction and inclination from the original borehole course. The use of such whipstock tools necessitates removal of the drill string to install a special whipstock guide and a reduced size drill bit in the borehole. Special measuring devices are then employed to position the whipstock as required for drilling the pilot hole in a given direction. The guide and its associated bit are subsequently removed and the drill string and original bit are returned to the borehole to resume drilling of the borehole along the deviated pilot hole. It is, therefore, apparent that such whipstock operations are too time-consuming and unduly expensive to be feasible except in extreme situations.

Perhaps the most common directional drilling technique in use today utilizes specially arranged drilling apparatus commonly called a "big eye" drill bit which has one of its several fluid nozzles enlarged and arranged to discharge a jet of the drilling mud in a selected lateral direction. To utilize these jet-deflection bits, rotation of the drill string is temporarily discontinued. By utilizing a typical orienting tool the drill string is manipulated so as to position the big eye bit with its enlarged nozzle facing in the direction in which the borehole is to be subsequently deviated. The mud pumps of the drilling rig are then operated so that a concentrated jet of the circulating drilling mud is forcibly discharged against the adjacent borehole wall surface so as to progressively erode away or carve out a cavity on that side of the borehole. Once it is believed that an adequate cavity has been carved out, the drilling operation is resumed with the expectation that the drill bit will be diverted into the eroded cavity and thereby initiate the desired deviation of the borehole. Typical tools of this nature are described, for example, in U.S. Pat. Nos. 3,360,057, 3,365,007, 3,488,765 and 3,599,733.

Those skilled in the art will recognize, of course, that such prior art jet deflection tools require many time-consuming directional measurements to correctly position the drill bit. It should also be recognized that while cutting a cavity with such prior art tools, the rate of penetration will be significantly decreased since the drill string can not be rotated during such prolonged operations. Thus, these prior art tools are not particularly efficient for deviating boreholes at extreme depths or those situated in hard earth formations. Moreover, since the drill string must be maintained stationary during the jetting operation, in some instances the drill string may possibly be subjected to so-called "differential sticking" at one or more locations in the borehole. Accordingly, heretofore other types of directional drilling tools have been proposed for redirecting the borehole without having to discontinue rotation of the drill string. One of the earlier tools of this nature is found in U.S. Pat. No. 2,075,064. In that tool, a valve is cooperatively arranged in a conventional drill bit and is controlled by a pendulum member with an eccentrically located center of gravity to equalize the discharge rate of drilling fluid from each of the bit nozzles to ensure that the drill bit will continue to follow a previously drilled pilot hole. Those skilled in the art will, of course, recognize that this particular apparatus is itself incapable of initiating a change in direction of a borehole. U.S. Pat. Nos. 3,593,810 and 4,307,786 respectively depict two directional drilling tools which are each selectively energized as rotation of the drill string carries a wall contacting member into momentary contact with the lower wall of an inclined borehole interval. The tool described in the first of these two patents is cooperatively arranged so that as the drill string is rotated, the periodic contact of the actuating member with the borehole wall is effective to selectively extend a laterally movable guiding member on the tool and thereby continuously urge the drill bit in a given lateral direction. The tool described in the second of these two patents is provided with a source of pressured fluid. In response to the periodic engagement of the wall contacting actuator with the lower wall of the borehole, the pressured fluid is repetitively emitted from a selected nozzle in a conventional drill bit so as to continuously direct the pressured fluid against only a selected circumferential portion of the borehole. Thus, continued operation of this prior art tool will be effective for progressively diverting the drill bit toward that portion of the borehole wall. Those skilled in the art will recognize, of course, that these two prior art tools are wholly dependent upon their respective actuating members being able to contact the borehole wall above the drill bit. Thus, should there be portions of the borehole wall which are so washed out that they cannot be contacted when these actuating members are fully extended, these particular tools will be incapable of operating properly in that borehole interval.

OBJECTS OF THE INVENTION

Accordingly, it is an object of the present invention to provide new and improved methods and apparatus for selectively directing earth-boring apparatus along selected courses as the boring apparatus is progressively excavating a borehole penetrating one or more subsurface earth formations.

SUMMARY OF THE INVENTION

This and other objects of the present invention are attained in the practice of the new and improved methods described herein by rotating earth-boring apparatus dependently suspended from a drill string in which a drilling fluid is circulating for progressively excavating a borehole; and, as the earth boring apparatus rotates, sequentially discharging the drilling fluid from each of several fluid passages in the earth-boring apparatus only into selected sectors of the borehole for operatively advancing the earth-boring apparatus along a selected course of excavation.

The objects of the present invention are further attained by providing new and improved directional drilling apparatus adapted to be coupled to rotatable earth-boring apparatus and dependently suspended in a borehole from a tubular drill string having a drilling fluid circulating therein. Means including two or more fluid passages in the earth-boring apparatus are cooperatively arranged for discharging angularly spaced streams of the drilling fluid into the adjacent portions of the borehole to clear away formation materials from the borehole surfaces as the earth-boring apparatus is rotated. The new and improved apparatus of the present invention further includes direction-measuring means and fluid-control means operable upon rotation of the earth-boring apparatus for sequentially discharging each of these fluid streams only into selected sectors of the borehole so as to selectively control the direction of advancement of the earth-boring apparatus as required for deviating the borehole in a selected direction.

Accordingly, to practice the methods of the present invention with the new and improved directional drilling apparatus, in one mode of operating this apparatus, the fluid-control means are selectively operated so that continued rotation of the earth-boring apparatus will be effective for sequentially discharging the several streams of drilling fluid into all adjacent sectors of the borehole for excavating the borehole along a generally straight course. In the alternative mode of operating the new and improved apparatus to practice the methods of the invention, the fluid-control means are selectively operated so that, as the earth-boring apparatus continues to rotate, these several fluid streams will be sequentially discharged into only a selected adjacent sector of the borehole. In this latter mode of operation, the repetitive discharge of the fluid streams into this selected borehole sector will progressively form a cavity in one surface thereof into which the earth-boring apparatus will advance for progressively diverting the earth-boring apparatus as required to drill a deviated interval of the borehole in a selected direction and inclination.

BRIEF DESCRIPTION OF THE DRAWINGS

The novel features of the present invention are set forth with particularity in the appended claims. The invention, together with further objects and advantages thereof, may be best understood by way of the following description of exemplary methods and apparatus employing the principles of the invention as illustrated in the accompanying drawings, in which:

FIG. 1 shows a preferred embodiment of a directional drilling tool arranged in accordance with the principles of the present invention as this new and improved tool may appear while practicing the methods of the present invention for drilling a borehole along a selected course of excavation;

FIG. 3 schematically depicts typical downhole and surface control circuitry and components that may be employed for the operation of the new and improved directional drilling tool of the present invention.

DETAILED DESCRIPTION OF THE INVENTION

Figure 2:
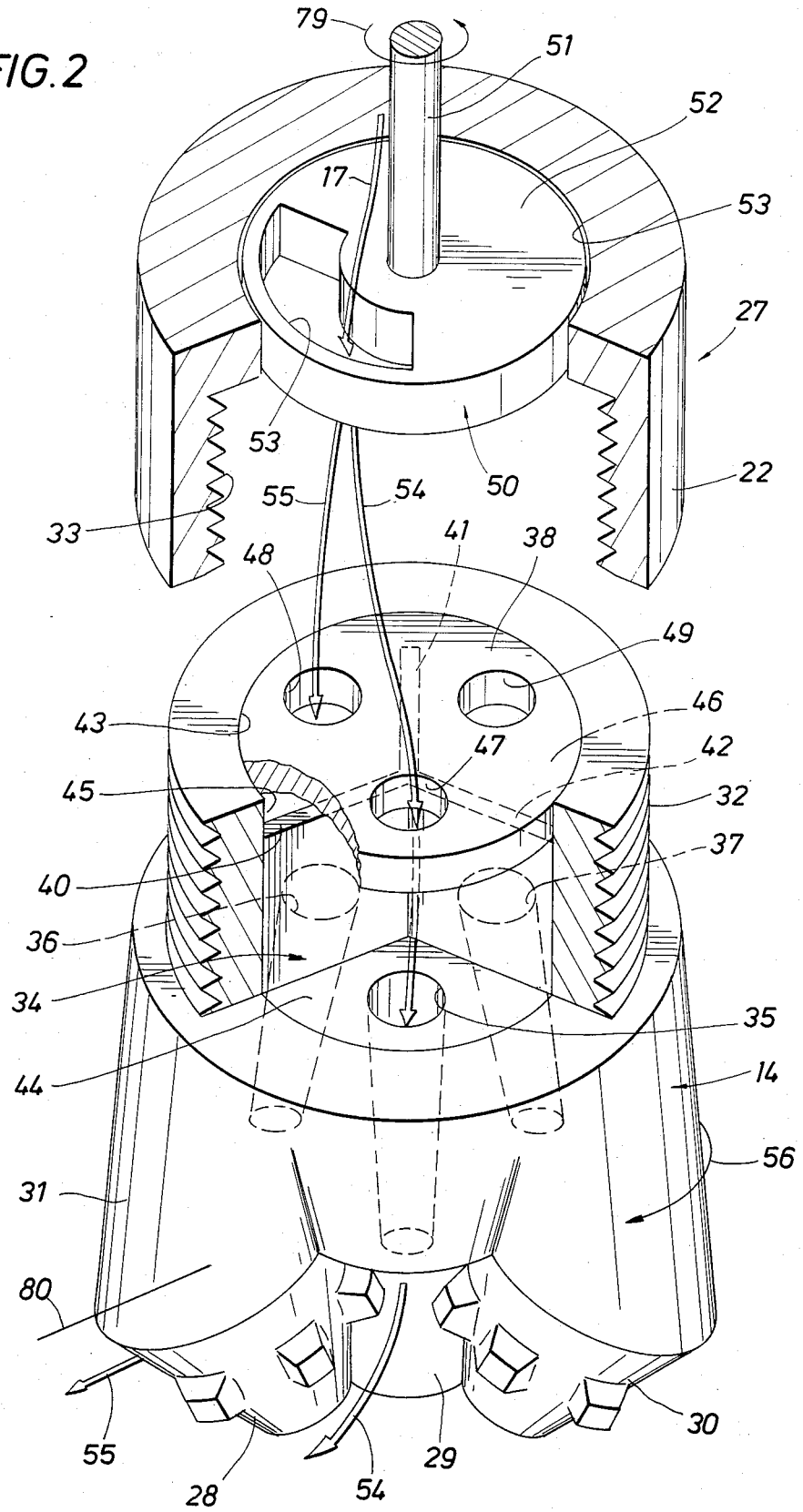
FIG. 2 is an exploded view having portions thereof shown in cross-section to better illustrate a preferred embodiment of fluid-diverting means and a typical drill bit such as may be operatively employed with the directional drilling tool shown in FIG. 1.

Turning now to FIG. 1, a new and improved directional drilling tool 10 arranged in accordance with the principles of the present invention is depicted dependently suspended from the lower end of a tubular drill string 11 typically compised of one or more drill collars, as at 12, and multiple joints of drill pipe as at 13. Rotatable earth-boring apparatus such as a typical drill bit 14 is coupled to the lower end of the directional drilling tool 10 and operatively arranged for excavating a borehole 15 through various subsurface earth formations, as at 16, in response to rotation of the drill string 11. As the drill string 11 is being rotated by a typical drilling rig (not shown) at the surface, a substantial volume of a suitable drilling fluid or a so-called "mud" is continuously pumped downwardly through the tubular drill string (as shown by the arrow 17). The mud 17 is subsequently discharged from multiple fluid passages (not seen in FIG. 1) in the drill bit 14 for cooling the bit as well as for carrying formation materials removed by the bit to the surface as the drilling mud is returned upwardly (as shown by the arrow 18) by way of the annular space in the borehole 15 outside of the drill string.

To facilitate the utilization and servicing of the tool 10, the directional drilling tool of the present invention is preferably arranged to include a plurality of tubular bodies, as at 19–22.

As will be later described in more detail with respect to FIG. 3, in the preferred embodiment of the directional drilling tool 10, the various bodies 19–22 are cooperatively arranged for respectively enclosing data-signalling means 23, direction measuring means 24 and direction controlling means 25. When desired, the tubular body 20 may also be arranged for enclosing typical condition-measuring means 26 for measuring such conditions as electrical or radioactivity properties of the adjacent earth formations, the temperature of the drilling mud in the borehole 15 as well as one or more operating conditions such as weight-on-bit and the torque in a selected portion of the drill string 11.

Turning now to FIG. 2, a preferred embodiment is depicted of new and improved fluid-direction means 27 arranged in accordance with the principles of the present invention. As illustrated there, the drill bit 14 is a typical rotary drill bit having a plurality of cutting members such as conical cutters 28–30, rotatably journalled in a sturdy body 31. To couple the bit 14 to the directional drilling tool 10, the upper portion of the bit body 31 is cooperatively threaded, as at 32, for threaded engagement with complementary threads 33 on the lower end of the tool body 22. As is typical for such drill bits, the bit body 31 includes flow-dividing means 34 such as three fluid passages 35–37 cooperatively arranged for dividing the drilling mud 17 flowing through the drill string 11 and evenly distributing these divided mud streams so as to flow between the bit cones 28–30 to cool and lubricate the bit as well as to flush away loosened formation materials which might otherwise collect between these cutting members.

In the preferred embodiment of the fluid-directing means 27 of the present invention, the flow-dividing means 34 further include a multi-ported member 38 having three angularly distributed partitions 40–42 dependently secured thereto. The member 38 and the partitions 40–42 are sealingly mounted within the axial bore 43 of the bit body 31 and cooperatively arranged for defining therein separated chambers or individual fluid passages 44–46 serving as upper extensions of their associated fluid passages 35–37 of the bit 14 which, by means of three uniformly-spaced ports 47–49 in the member 38, respectively communicate the bit passages with the upper portion of the axial bore 43. The fluid-directing means 27 further include a fluid-diverting member 50 having an axially aligned shaft 51 rotatably journalled in the tool body 22 by one or more bearings (not illustrated). As will be subsequently described with reference to FIG. 3, the fluid-diverting member 50 is cooperatively arranged for rotation in a transverse plane cutting the lower end of the tool body 22 and lying immediately above the multi-ported member 38 when this tool body is coupled to the bit 14.

Although other arrangements may, of course, be employed without departing from the principles of the present invention, the rotatable diverter 50 is preferably configured so that at least one of the three fluid ports 47, 48 or 49 will be substantially blocked in any given angular position of the diverter. In the preferred manner of accomplishing this, the diverter 50 is arranged as a circular member having a segmental flow-obstructing portion 52 which subtends an arc of 240 degrees (i.e., twice the angular spacing of the equally spaced fluid ports 47–49) and a flow-directing portion such as an arcuate opening 53 which subtends an arc of 120 degrees (i.e., equal to the angular spacing between the ports 47–49).

As depicted in FIG. 2, it will be appreciated that by positioning the diverter member 50 with its flow-directing opening 53 spanning any two of the three ports, as at 47 and 48, the opposite ends of the arcuate opening will uncover half of each of these two ports and the flow-obstructing portion 52 will block the other half of each of these two ports as well as all of the other port 49. In this illustrated position of the diverter 50, the flow of drilling mud, as at 17, will be cooperatively divided into two substantially equal parallel portions, as at 54 and 55, that will successively pass through the uncovered halves of the ports 47 and 48, flow on through their respectively associated bit passages 35 and 36, and subsequently exit from the lower end of the drill bit 14 to pass on opposite sides of the cutting member 28. In addition to clearing away loose formation materials that may be below the drill bit 14, the divided fluid streams 54 and 55 exiting at that moment from the bit passages 35 and 36 will be directed only into that sector of the borehole 15 which is at that time immediately adjacent to that side of the drill bit. Accordingly, unless the drill bit 14 is rotating at that particular moment, the continued discharge of the fluid stream, as at 54 and 55, into this sector of the borehole 15 will ultimately be effective for eroding away the adjacent borehole surface.

As will be subsequently described by reference to FIG. 3, the diverter 50 is adapted so that it can be selectively positioned as required for communicating the flowing drilling mud, as at 17, with any given one or two of the three fluid ports 47–49. Thus, depending on which of the three bit passages 35, 36 or 37 are to be obstructed at any given time, the fluid diverter 50 can be selectivelly positioned as desired to cooperatively direct streams of drilling mud, such as those shown at 54 and 55, into any given sector of the borehole 15. All that is necessary is to rotate the diverter 50 to the angular position in relation to the drill bit 14 that is required for correspondingly discharging one or two streams of drilling mud into the selected borehole sector.

It should be noted, however, that rotation of the drill string 11 is effective for rotating the drill bit 14 in the direction of the arrow 56. Thus, should the fluid diverter 50 simply remain stationary and be left in a given angular position in relation to the bit body 31 such as the position of the diverter depicted in FIG. 2, rotation of the drill bit 14 will correspondingly cause the divided fluid streams 54 and 55 to be traversed around the entire circumference of the borehole 15. This continued traversal of the fluid stream 54 and 55 would, of course, be ineffective for laterally diverting the drill bit 14 in any given direction. Moreover, should the fluid streams 54 and 55 continue to be discharged only on opposite sides of the one cutting member 28, clays or loose formation materials would quickly build up in the spaces between the other cutting members 29 and 30 and reduce the effectiveness of the drill bit 14 by a corresponding amount.

It is, of course, the principal object of the present invention to employ the new and improved directional drilling tool 10 for selectively directing the advancement of earth boring apparatus, such as the drill bit 14, along a desired course of excavation. In the preferred manner of accomplishing this object, the new and improved directional drilling tool 10 may be arranged as depicted somewhat schematically in FIG. 3. As is recognized by those skilled in the art, the stream of drilling mud, as at 17, flowing through the drill string 11 (FIG. 1) serves an an effective medium for transmitting acoustic signals to the surface at the speed of sound in that particular drilling mud. Accordingly, as illustrated in FIG. 3, the data-signalling means 23 preferably include an acoustic signaler 57 such as one of those described, for example, in U.S. Pat. Nos. 3,309,565 and 3,764,970 for transmitting either frequency-modulated or phase-encoded data signals to the surface by way of the flowing mud stream as at 17. As fully described in those and other related patents, the signaler 57 includes a fixed stator 58 operatively associated with a rotatable rotor 59 for producing acoustic signals of the desired character. This rotor 59 is rotatively driven by means such as a typical motor 60 operatively controlled by way of a suitable motor-control circuitry as at 61. The data-signalling means 23 further include a typical turbine-driven hydraulic pump 62 which utilizes the flowing mud stream, as at 17, for supplying hydraulic fluid as required for driving the signaler motor 60 as well as a motor-driven generator 63 supplying power to the several electrical components of the directional drilling tool 10.

In the preferred embodiment of the new and improved tool 10, the direction measuring means 24 include means such as a typical triaxial magnetometer 64 cooperatively arranged for providing electrical output signals representative of the angular positions of the directional drilling tool relative to a fixed, known reference such as the magnetic north pole of the earth. In the preferred embodiment of the tool 10, the direction-measuring means 24 further include means such as a typical triaxial accelerometer 65 that is cooperatively arranged for providing electrical output signals that are representative of the inclination of the tool with respect to the vertical. The output signals of these two direction-measuring devices 64 and 65 are operatively coupled to the data-acquisition and motor control circuitry 61 as required for cooperatively driving the acoustic signaler motor 60. Those skilled in the art will also appreciate that the output signals of the condition-measuring means 26 may also be coupled to the data-acquisition and motor-control circuitry 61 for transmitting data signals representative of these measured conditions to the surface.

As is typical with acoustic signalers as at 57, a suitable pressure-responsive signal detector 66 is cooperatively arranged in a conduit 67 coupled between the discharge side of the mud pump (not illustrated) and the surface end of the drill string 11 (FIG. 1) for detecting the cyclic pressure variations developed by the acoustic signaler in the flowing mud stream 17 passing through the conduit. To convert these acoustic signals into appropriate electrical signals, suitable signal-decoding and processing circuitry 68 is coupled to the signal detector 66 and adapted to convert the data conveyed by the acoustic signals in the mud stream 17 to a signal form which is appropriate for driving a typical signal recorder 69. As is customary, the signal recorder 69 is appropriately arranged for recording the data measurements carried by the acoustic signals as a function of the depth of the drill bit 14.

It will be recalled, of course, that the principal object of the present invention is to employ the new and improved directional drilling tool 10 for selectively directing the advancement of earth-boring apparatus, such as the drill bit 14, along a desired course of excavation. Thus, the direction-measuring means 24 are cooperatively arranged for producing output control signals which are representative of the spatial position of the directional control tool 10 in the borehole 15. To accomplish this, the output signals of the magnetometer 64 and the accelerometer 65 are respectively correlated with appropriate reference signals, as at 70 and 71, and combined by circuitry 72 for providing output control signals which are representative of the azimuthal position and inclination of the directional drilling tool 10 in the borehole 15. The output tool position signals produced by the circuitry 72 are operatively coupled by means of typical summing-and-integrating circuitry 73 to a typical hydraulic or electrical driver 75 which is coupled to the shaft 51 and arranged for selectively driving the diverter 50 at various rotational speeds. To provide suitable feedback control signals to the motor 75, the direction controlling means 25 further include a rotary-position transducer 76 operatively arranged for providing output signals that are representative of the rotational speed of the fluid diverter 50 as well as its angular position in relation to the tool body 22 and the drill bit 14. As is common, feedback signals from the transducer 76 are coupled to the circuitry 73 for controlling the driver 75. The output signals from the transducer 76 are also coupled to the data-acquisition and motor-control circuitry 61 for providing output signals at the surface representative of the rotational speed and the angular position of the fluid diverter 50 in relation to the body 22 of the new and improved directional drilling tool 10.

It will, of course, be recognized that suitable control means must also be provided for selectively changing the various modes of operation of the directional drilling tool 10. In one manner of accomplishing this, a reference signal source, as at 77, is cooperatively arranged to be selectively coupled to the servo driver 75 by means such as by a typical control device 78 mounted in the tool body 22 and adapted to operate in response to changes in some selected downhole condition which can be readily varied or controlled from the surface. For instance, the control device 78 could be chosen to be responsive to predetermined changes in the flow rate of the drilling mud 17 in the drill string 11. Should this be the case, the directional-controlling means 25 could be readily changed from one operational mode to another desired mode by simply controlling the mud pumps (not depicted) as required to momentarily increase or decrease the flow rate of the drilling mud 17 which is then circulating in the drill string 11 to some predetermined higher or lower flow rate. The control device 78 could just as well be chosen to be actuated in response to predetermined levels or variations in the weight-on-bit measurements in the drill string 11. Conversely, an alternative remotely-actuated device 78 could be one that would be responsive to the passage of slugs of a radioactive tracer fluid in the drilling mud stream 17. Still other means for selectively actuating the control device 78 will, of course, be apparent to those skilled in the art.

Figure 4A:
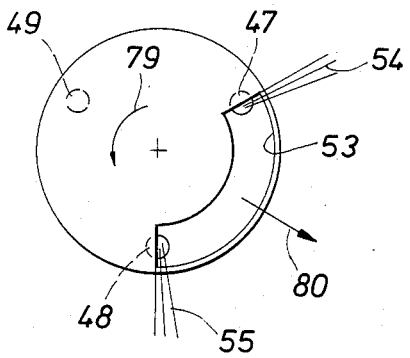
FIGS. 4-A to 4-C, 5-A to 5-C and 6-A to 6-C schematically show typical modes of operation of the fluid-diverting means of the present invention.
Figure 4B:
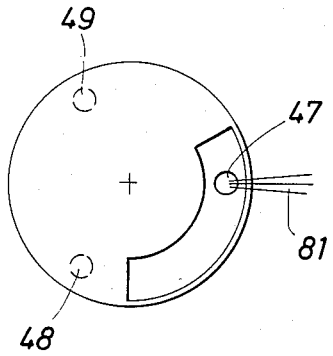
Figure 4C:
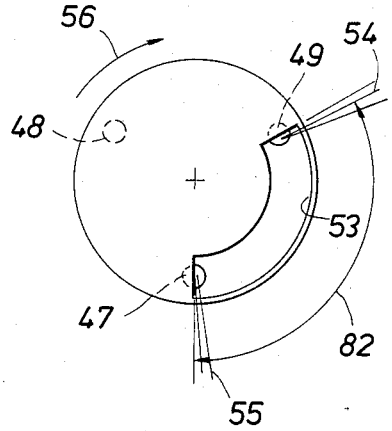

Accordingly, in the idealized manner of operating the new and improved directional drilling tool 10, the motor 75 is operated for selectively rotating the fluid diverter 50 in the direction indicated by the arrow 79 (FIG. 2). It should be particularly noted that the rotational direction 79 of the diverter 50 is preferably counter to the rotational direction 56 of the drill bit 14. In keeping with the objects of the present invention, to divert the drill bit 14 laterally along an axis as generally indicated by the line 80 (FIG. 2), the direction controlling means 25 are operated so that the fluid diverter 50 will be counter rotated at substantially the same rotational speed of the drill bit. As schematically illustrated in FIGS. 4-A to 4-C, counter rotation of the fluid diverter 50 at the same rotational speed as the drill bit 14 will operatively maintain the diverter in the same spatial position in relation to the borehole 15. In effect, the diverter 50 will be in a fixed angular position in relation to a given sector of the borehole 15 while the tool 10, drill string 11 and drill bit 14 rotate relative to the diverter so continued rotation of the drill bit will successively rotate the ports 47–49 one after another into momentary alignment with the arcuate fluid-directing opening 53. Thus, as the bit passages 35–37 are each communicated with the fluid-directing opening 53, the circulating mud 17 will be sequentially discharged from the rotating drill bit 14 either as dual fluid streams (as at 54 and 55) or as a single fluid stream (as at 81), with each of these fluid streams being sequentially discharged only into the immediately-adjacent borehole sector 82. As previously noted, the sequential discharge of these dual fluid streams (as at 54 and 55) and the single fluid streams (as at 81) will repetitively direct these several streams across only those borehole surfaces lying in that particular sector 82 of the borehole 15. Thus, in time, the repetitive discharge of these several mud streams, as at 54, 55 and 81, will cause the bit 14 to cut away more of the surfaces in that selected borehole sector 82 and thereby divert the drill bit laterally along the axis 80 generally bisecting that borehole sector. In keeping with the objects of the present invention, it should also be noted that the counter rotation of the drill bit 14 and the fluid diverter 50 will also be effective for successively discharging a stream of drilling mud from each of the bit passages 35–37 so that the cutting members 28–30 will be continuously cleaned to thereby enhance the cutting efficiency of the drill bit 14.

Figure 5A:
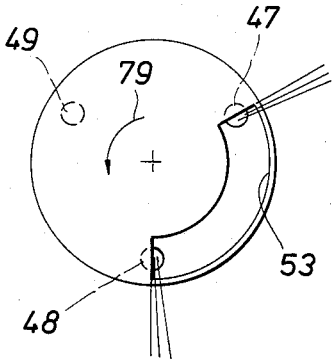
Figure 5B:
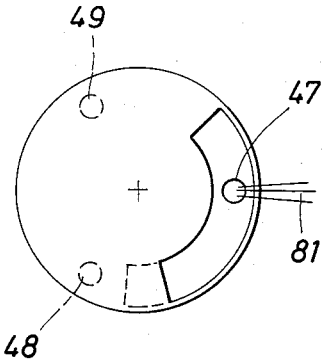
Figure 5C:
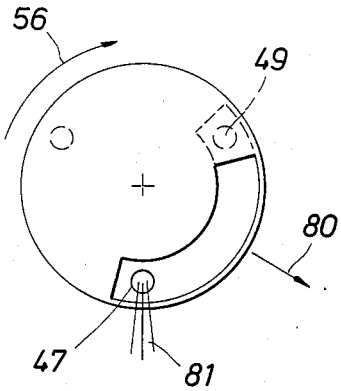

Those skilled in the art will, of course, recognize that the rotational speed of the drill bit 14 will be continuously varying during a typical drilling operation as the bit successively meets greater or less opposition to its further progress. Thus, in practice, the operation of the direction-controlling means 25 is better directed toward retaining the fluid diverter 50 in a fixed relative position in the borehole 15 that it is to maintain equal rotational speeds of the drill bit 14 and diverter. The output signals of the magnetometer 64 and the rotary-position transducer 76 will, of course, provide the necessary control signals for maintaining the diverter 50 in a given angular relationship with respect to the borehole 15 and within the limits established by the azimuth reference signals 70. Accordingly, in the operation of the new and improved directional drilling tool 10, it would be expected that the fluid diverter 50 would tend to vacillate or waver back and forth on opposite sides of a given position as the direction controlling means 25 operate for positioning the diverter in a given angular position. Thus, as schematically represented in FIGS. 5-A to 5-C, instead of the diverter 50 precisely remaining in the same angular position as shown in the idealized situation portrayed in FIGS. 4-A to 4-C, the diverter will ordinarily shift back and forth on opposite sides of the line 80 within a limited span of movement. Nevertheless, as seen in FIGS. 5-A to 5-C, the several fluid streams, as at 54, 55 and 81, will still be sequentially discharged into the selected borehole sector 82 for accomplishing the objects of the present invention.

Figure 6A:
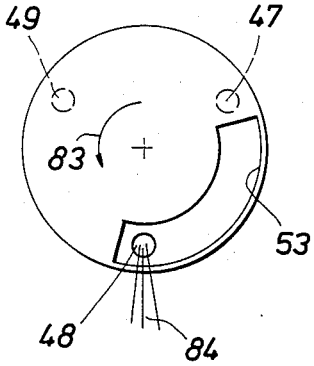
Figure 6B:
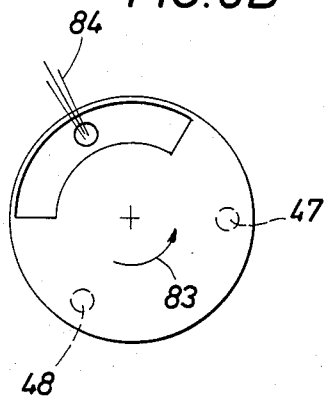
Figure 6C:
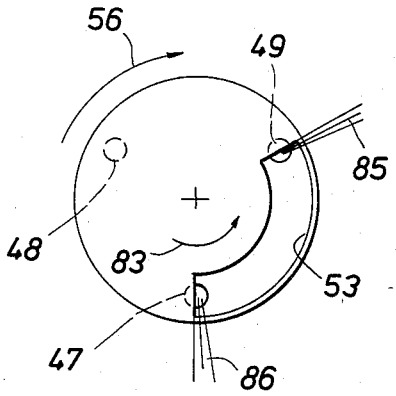

It will, of course, be appreciated that the continued diversion of the drill bit 14 in a selected lateral direction will progressively excavate the borehole 15 along an extended, somewhat arcuate course. It is, however, not always feasible nor necessary to continue deviation of a given borehole as at 15. Thus, in keeping with the objects of the present invention, the direction-controlling means 25 are further arranged so that, when desired, further diversion of the drill bit 14 can be selectively discontinued so that the drill bit will thereafter advance along a generally straight-line course of excavation. Thus, in the preferred manner of operating the directional drilling tool 10, the remotely-actuated control device 78 is actuated (such as, for example, by effecting a momentary change in the speed of the mud pumps at the surface) to cause the driving motor 75 to function as necessary to rotate the diverter 50 at a nonsynchronous speed in relation to the rotational speed of the drill bit 14. It will be recognized, therefore, that by rotating the fluid diverter 50 at a rotational speed that is not equal to the rotational speed of the drill bit 14, in the idealized operation of the tool 10, the flow-directing opening 53 will neither remain in a selected position that is fixed in relation to the borehole 15 (such as would be the case if the driving motor 75 is operated as previously explained) nor remain in a position that is fixed in relation to the drill bit 14 (such as would be the case were the driving motor 75 simply halted). As illustrated in FIGS. 6-A to 6-C, the net effect of such nonsynchronous rotation (as at 83) of the diverter 50 with respect to the rotation 56 of the drill bit 14 will be effective for sequentially discharging one or two streams of the drilling mud, as at 83–85, into more than one sector of the borehole 15. This latter situation is, of course, distinctly different than the situation depicted in FIGS. 4-A to 5-C where, as previously described, the several fluid streams, as at 54, 55 and 81, are sequentially discharged only into the selected borehole sector 82. It will, therefore, be appreciated that where several fluid streams, as at 84–86, are sequentially discharged in a random order into different borehole sectors, there will be little, if any, diversion of the drill bit 14.

Those skilled in the art will recognize, of course, that the same operation of the direction-controlling means 25 can be realized by cooperatively operating the driving motor 75 so as to selectively advance and retard the rotational position of the diverter 50 with respect to the borehole 15. If the limits of such advancement and retardation are set sufficiently far apart, the net result will be simply swing the flow-diverting opening 53 back and forth over a sufficiently large span of travel that the several fluid streams (as at 84–86) will be selectively emitted into most, if not all, adjacent sectors of the borehole 15. It should also be considered that this alternate advancement and retardation of the fluid diverter 50 will be similar to the back and forth movement of the diverter as depicted in FIGS. 5-A to 5-C except that the limits of movement will be much greater than the relatively narrow limits illustrated there so that the sequentially emitted fluid streams (as at 54, 55 and 81) will essentially traverse the full circumference of the borehole 15.

From the previous description of the present invention, it will be realized that the surface recorder 69 will permit the operator to monitor the operation of the new and improved drilling control tool 10. Moreover, by virtue of the directional-controlling means 25, the operator can also be aware of the position of the fluid diverter 50 and selected the operational mode of the tool 10 as the borehole 15 is being drilled as well as subsequently change its operational mode by simply actuating the remotely-actuated control device 78.

If, for example, it is desired to discontinue drilling a given interval of the borehole 15 along a generally straight course of excavation and then begin drilling the succeeding interval of the borehole along a progressively changing course, the condition-responsive device 78 is actuated from the surface in a suitable manner for moving the diverter 50 to a selected angular position in relation to the borehole. As previously described in relation to FIGS. 4-A to 4-C, this is ideally accomplished by rotating the diverter 50 counter to and at the same rotational speed as the drill bit 14. The actuation of the control device 78 will be effective, therefore, for thereafter sequentially discharging the several streams of drilling mud (as at 54, 55 and 81) into only one selected sector (as at 82) of the borehole 15. Thereafter, the direction-measuring means 24 will provide sufficient data measurements at the surface for the operator to monitor the spatial position of the new and improved directional drilling tool 10 in the borehole 15 as well as reliably control the further advancement of the drill bit 14. Whenever the various data measurements shown on the recorder 69 subsequently indicate that the drill bit 14 is now advancing along an appropriate course of excavation, the condition-responsive device 78 is again actuated from the surface as required to begin driving the fluid diverter 50 at a nonsynchronous speed so that the drill bit will thereafter continue drilling the borehole 15 along a generally straight course of excavation as was previously described by reference to FIGS. 6-A to 6-C. These several sequences of operation can, of course, be repeated as many times as may be required for the borehole 15 to be excavated along various courses of excavation.

Accordingly, it will be understood that the present invention has provided new and improved methods and apparatus for guiding well-boring apparatus such as a typical drill bit as it progressively excavates one or more discrete intervals of a borehole. By employing the directional drilling tool disclosed herein, well-boring apparatus coupled thereto can be reliably advanced in any selected direction during the course of a drilling operation without requiring the removal of the drill string or the use of special apparatus to make corrective course adjustments for the new and improved directional drilling tool of the present invention to reach a desired remote location.

While only particular embodiments of the present invention have been shown and described, it is apparent that changes and modifications may be made without departing from this invention in its broader aspects; and, therefore, the aim in the appended claims is to cover all such changes and modifications as fall within the true spirit and scope of this invention.

What is claimed is:

1. Apparatus adapted for controlling the direction in which a borehole is being excavated and comprising:

a body adapted to be coupled to rotatable earth-boring apparatus and dependently supported in a borehole from a tubular drill string in which a drilling fluid is circulating;

first means cooperatively arranged on said body and adapted for dividing a drilling fluid circulating in a tubular drill string supporting said body into at least two fluid streams to be respectively discharged from rotating earth-boring apparatus coupled to said body and into angularly-spaced sectors of a borehole being excavated; and second means cooperatively arranged on said body and adapted upon rotation of a rotatable earth-boring apparatus coupled to said body to be either selectively operated for sequentially discharging each of such fluid streams into at least two angularly-separated borehole sectors to direct said body along a first course of excavation or selectively operated for sequentially discharging each of such fluid streams into only a single borehole sector to direct said body along a second course of excavation.

2. The apparatus of claim 1 wherein said first means include at least two separate fluid passages in said body respectively adapted to provide fluid communication between a tubular drill string supporting said body and corresponding fluid discharge outlets in a rotatable earth-boring apparatus coupled to said body; and said second means include a flow-obstructing member, means rotatably journaling said flow-obstructing member in said body, and driving means selectively operable and adapted for rotating said flow obstructing member at a first rotational speed to sequentially admit drilling fluid into each of said separate fluid passages for discharge therefrom into all borehole sectors and selectively operable and adapted for rotating said flow-obstructing member at a second rotational speed to sequentially admit drilling fluid into each of said separate fluid passages for discharge therefrom into only a single borehole sector.

3. Directional drilling apparatus adapted for drilling a borehole along one or more selected axes and comprising:

a body having a longitudinal passage and adapted to be dependently supported in a borehole and rotated by a tubular drill string in which a drilling fluid is circulating;

earth-boring means coupled to said body for rotation thereby and including two or more fluid outlets in communication with said longitudinal passage and respectively adapted for discharging separate streams of drilling fluid into adjacent borehole sectors upon rotation of said earth-boring means to clear away formation materials from said earth-boring means and adjacent borehole surfaces; and direction controlling means including fluid-directing means selectively operable upon rotation of said earth-boring means for either discharging streams of drilling fluid from each of said fluid outlets into all adjacent angularly-spaced borehole sectors to direct said earth-boring means along a first course or discharging streams of drilling fluid from each of said fluid outlets into only a single adjacent borehole sector to redirect said earth-boring means along a second course.

4. The directional drilling apparatus of claim 3 further including direction measuring means cooperatively arranged on said body and adapted for measuring at least one parameter indicative of the position of said apparatus; and control means responsive to measurements of said direction-measuring means and adapted for alternatively operating said fluid-directing means in a first mode of operation to direct said earth-boring means along said first course or in a second mode of operation to redirect said earth-boring means along said second course.

5. The directional drilling apparatus of claim 4 wherein said control means further include means operable for selecting the mode of operation for said fluid directing means.

6. The directional drilling apparatus of claim 4 wherein said control means further include means operable from the surface for selecting the mode of operation for said fluid-directing means.

7. The directional drilling apparatus of claim 4 wherein said control means further include means on said body and adapted for selecting the mode of operation for said fluid-directing means in response to a predetermined downhole condition.

8. The directional drilling apparatus of claim 4 wherein said control means further include means on said body and adapted for selecting the mode of operation for said fluid-directing means in response to a variable downhole condition which may be selectively varied from the surface for alternatively selecting each of said modes of operation.

9. Directional drilling apparatus adapted for drilling a borehole along one or more selected axes and comprising:

a first body having a fluid passage therein and adapted to be dependently suspended in a borehole and rotated by a tubular drill string in which a drilling fluid is circulating;

a rotary drill bit including a second body coupled to said first body for rotation thereby, means on said second body defining at least three separate fluid passages operatively arranged and adapted upon rotation of said drill bit for respectively discharging separate angularly-displaced streams of a drilling fluid into adjacent borehole sectors to clear away formation materials from ahead of said drill bit and on adjacent borehole surfaces;

direction-controlling means including fluid-directing means operatively arranged in one of said bodies for selectively communicating said fluid passages upon rotation of said drill bit and including a flow obstructing member, means rotatably journaling said flow obstructing member in one of said bodies for rotation between successive operating positions respectively obstructing fluid communication through at least one of said three separate passages and establishing fluid communication in the remaining separate passages, driving means selectively operable for rotating said flow-obstructing member between its said successive operating positions in a first mode of operation selected to sequentially discharge drilling fluid from each of said three separate passages into adjacent angularly-displaced borehole sectors to uniformly clear away formation materials ahead of said drill bit and for rotating said flow-obstructing member between its said successive operating positions in a second mode of operation to sequentially discharge drilling fluid from each of said separate fluid passages into only into a single borehole sector to preferentially clear away formation materials in said single borehole sector ahead of said drill bit.

10. The directional drilling apparatus of claim 9 further including direction measuring means cooperatively arranged on one of said bodies and adapted for measuring at least one parameter indicative of the spatial position of said bodies; and control means responsive to measurements of said direction-measuring means and operatively coupled to said driving means and adapted for alternatively rotating said flow-obstructing member in either of its said first and second modes of operation.

11. The directional drilling apparatus of claim 10 wherein said control means further include means for selecting the mode of operation of said flow-obstructing member.

12. The directional drilling apparatus of claim 10 wherein said control means further include means operable from the surface for selecting the mode of operation of said flow-obstructing member.

13. The directional drilling apparatus of claim 10 wherein said control means further include means on one of said bodies and adapted for selecting the mode of operation of said flow-obstructing member in response to a predetermined downhole condition.

14. The directional drilling apparatus of claim 10 wherein said control means further includes means on one of said bodies and adapted for selecting the mode of operation of said flow-obstructing member in response to a variable downhole condition which may be selectively varied from the surface.

15. A method for selectively excavating an inclined borehole with rotatable earth-boring apparatus suspended from a tubular drill string having a drilling fluid circulating therethrough, said earth-boring apparatus having a plurality of fluid passages respectively arranged therein for discharging a stream of said drilling fluid into an adjacent sector of said inclined borehole as said earth-boring apparatus is being advanced, and comprising the steps of:

determining the azimuthal direction and angular inclination in which said earth-boring apparatus is advancing in said inclined borehole;

whenever said earth-boring apparatus is advancing in a selected azimuthal direction, discharging said drilling fluid in a controlled sequence from each of said fluid passages as said earth-boring apparatus is rotating for selectively directing said streams of drilling fluid into angularly-separated sectors of said inclined borehole to advance said earth-boring apparatus further in said selected azimuthal direction as it continues to excavate said inclined borehole;

whenever said earth-boring apparatus is advancing at a selected angular inclination, discharging said drilling fluid in a controlled sequence from each of said fluid passage as said earth-boring apparatus is rotating for selectively directing said streams of drilling fluid into angularly-separated sectors of said inclined borehole to advance said earth-boring apparatus further at said selected angular inclination as it continues to excavate said inclined borehole;

whenever said earth-boring apparatus is not advancing in said selected azimuthal direction, discharging said drilling fluid in a controlled sequence from each of said fluid passages as said earth-boring apparatus is rotating for selectively directing said streams of drilling fluid into only a single selected sector of said inclined borehole to divert said earth-boring apparatus toward said selected azimuthal direction as it continues to excavate said inclined borehole; and whenever said earth-boring apparatus is not advancing at said selected angular inclination, discharging said drilling fluid in a controlled sequence from each of said fluid passages as said earth-boring apparatus is rotating for selectively directing said streams of drilling fluid into only a single selected sector of said inclined borehole to divert said earth-boring apparatus toward said selected angular inclination as it continues to excavate said inclined borehole.

16. The method of claim 15 including the subsequent steps of: whenever said earth-boring apparatus is being diverted toward said selected azimuthal direction, determining the angular inclination at which said earth-boring apparatus is then advancing; and whenever said earth-boring apparatus is not advancing at said selected angular inclination, discharging said drilling fluid in a controlled sequence from each of said fluid passages as said earth-boring apparatus is rotating for selectively directing said streams of drilling fluid into only a single selected sector of said inclined borehole to divert said said earth-boring apparatus toward said selected azimuthal direction and angular inclination as it continues to excavate said inclined borehole.

17. The method of claim 15 including the subsequent steps of: whenever said earth-boring apparatus is being diverted toward said selected angular inclination, determining the azimuthal direction at which said earth-boring apparatus is then advancing; and whenever said earth-boring apparatus is not advancing in said selected azimuthal direction, discharging said drilling fluid in a controlled sequence from each of said fluid passages as said earth-boring apparatus is rotating for selectively directing said streams of drilling fluid into only a single selected sector of said inclined borehole to divert said earth-boring apparatus toward said selected azimuthal direction and angular inclination as it continues to excavate said inclined borehole.

18. The method of claim 15 further including the steps of: whenever said earth-boring apparatus is not advancing either in said selected azimuthal direction or at said selected angular inclination, discharging said drilling fluid in a controlled sequence from each of said fluid passages as said earth-boring apparatus is rotating for selectively directing said streams of drilling fluid into only a single selected sector of said inclined borehole to simultaneously divert said earth-boring apparatus toward said selected azimuthal direction and angular inclination as it continues to excavate said incline borehole.

19. A method for excavating an inclined borehole along selected courses of excavation with rotatable earth-boring apparatus suspended from a tubular drill string having a drilling fluid circulating therethrough, said earth-boring apparatus having a plurality of fluid passages respectively arranged therein for discharging a stream of said drilling fluid into an adjacent sector of said borehole, and comprising the steps of: while said earth-boring apparatus is advancing along a first course of excavation, obtaining measurements representative of the azimuthal direction of said first course of excavation in relation to a selected first azimuthal direction;

so long as said measurements indicate that said earth-boring apparatus is advancing in said first azimuthal direction, sequentially discharging said streams of drilling fluid from each of said fluid passages into angularly-separated sectors of said borehole while rotating said earth-boring apparatus for progressively excavating a first inclined interval of said borehole in said first azimuthal direction;

whenever said first inclined interval is to be terminated, sequentially discharging said drilling fluid from each of said fluid passages into only a selected sector of said borehole lying in a selected second azimuthal direction while rotating said earth-boring apparatus for diverting said earth-boring apparatus to a second course of excavation;

while said earth-boring apparatus is advancing along said second course of excavation, obtaining additional measurements representative of the azimuthal direction of said second course of excavation in relation to said second azimuthal direction; and once said additional measurements indicate that said earth-boring apparatus is advancing in said second azimuthal direction, sequentially discharging said streams of drilling fluid from each of said fluid passages into angularly-separated sectors of said borehole while rotating aid earth-boring apparatus for progressively excavating a second inclined interval of said borehole in said second azimuthal direction.

20. The method of claim 19 further including the steps of obtaining further measurements representative of the angular inclination of said earth-boring apparatus in one of said inclined borehole intervals in relation to a selected angular inclination; and so long as said further measurements indicate that said earth-boring apparatus is advancing at said selected angular inclination, sequentially discharging said streams of drilling fluid from each of said fluid passages into angularly-separated sectors of said borehole while rotating said earth-boring apparatus for progressively excavating said one borehole interval along said selected inclination; and whenever said further measurements indicate that said earth-boring apparatus is not advancing along said selected angular inclination, sequentially discharging said streams of drilling fluid from each of said fluid passages into only a selected sector of said borehole while rotating said earth-boring apparatus for diverting said earth-boring apparatus toward said selected angular inclination as it continues to advance in said one borehole interval.

21. A method for drilling a borehole with a rotary drill bit suspended from a rotatable tubular drill string having a drilling fluid circulating therethrough, said drill bit having a plurality of fluid passages arranged therein for respectively discharging a stream of drilling fluid into an adjacent peripheral sector of said borehole, and comprising the steps of:

rotating said drill string for operatively rotating said drill bit to drill a borehole into the earth;

sequentially discharging said drilling fluid from each of said fluid passages into multiple peripheral sectors of said borehole as said drill bit rotates for progressively drilling a first interval of said borehole along a generally-linear course of excavation;

whenever an inclined interval of said borehole is to be drilled in a selected azimuthal direction, sequentially discharging said drilling fluid from each of said fluid passages into only a single peripheral sector of said borehole facing in said selected azimuthal direction as said drill bit rotates for progressively drilling a second interval of said borehole along a generally-arcuate course of excavation toward said selected azimuthal direction;

obtaining measurements indicative of the direction of advancement of said drill bit in said second borehole interval in relation to said selected azimuthal direction; and whenever said directional measurements indicate that said drill bit is then advancing in said selected azimuthal direction, sequentially discharging said drilling fluid from each of said fluid passages into multiple peripheral sectors of said borehole as said drill bit rotates for progressively drilling an inclined third interval of said borehole along a generally-linear course of excavation in said selected azimuthal direction.

22. The method of claim 21 further including the steps of: obtaining measurements indicative of the angular inclination of said drill bit in said third borehole interval in relation to a selected angular inclination; whenever said inclinational measurements indicate that said drill bit is not advancing at said selected angular inclination, sequentially discharging said drilling fluid from each of said fluid passages into only a single selected peripheral sector of said borehole as said drill bit rotates for progressively diverting said drill bit until said until said drill bit is advancing at said selected angular inclination; and whenever said inclinational measurements indicate that said drill bit is advancing at said selected angular inclination, sequentially discharging said drilling fluid from each of said fluid passages into multiple peripheral sectors of said borehole as said drill bit rotates for progressively drilling said inclined third interval of said borehole along a generally-linear course of excavation in said selected azimuthal at said selected angular inclination.

* * * * *